US010065795B2

(12) United States Patent
Rondelli

(10) Patent No.: US 10,065,795 B2
(45) Date of Patent: Sep. 4, 2018

(54) CAPSULES FOR INFUSION PRODUCTS

(71) Applicant: MACCHIAVELLI S.r.l., San Lazzaro di Savena (Bologna) (IT)

(72) Inventor: Raffaele Rondelli, Argelato (IT)

(73) Assignee: MACCHIAVELLI S.R.L., San Lazzaro di Savena (Bologna) (IT)

( * ) Notice: Subject to any disclaimer, the term of this patent is extended or adjusted under 35 U.S.C. 154(b) by 0 days.

(21) Appl. No.: 15/304,084

(22) PCT Filed: Apr. 21, 2015

(86) PCT No.: PCT/IB2015/052908

§ 371 (c)(1),
(2) Date: Oct. 14, 2016

(87) PCT Pub. No.: WO2015/162556

PCT Pub. Date: Oct. 29, 2015

(65) Prior Publication Data

US 2017/0029204 A1 Feb. 2, 2017

(30) Foreign Application Priority Data

Apr. 22, 2014 (IT) ..... TO2014A0338

(51) Int. Cl.
*B65D 85/804* (2006.01)

(52) U.S. Cl.
CPC ..... *B65D 85/8043* (2013.01)

(58) Field of Classification Search
CPC ..... B65D 85/8043
See application file for complete search history.

(56) References Cited

U.S. PATENT DOCUMENTS

2011/0033580 A1* 2/2011 Biesheuvel ..... A23F 5/18 426/77

FOREIGN PATENT DOCUMENTS

| | | | |
|---|---|---|---|
| DE | 202006013189 | U1 | 10/2006 |
| WO | 2005026018 | A1 | 3/2005 |
| WO | 2005105609 | A2 | 11/2005 |
| WO | 2010137955 | A1 | 12/2010 |
| WO | 2013132435 | A1 | 9/2013 |
| WO | 2013144838 | A1 | 10/2013 |
| WO | 2013171328 | A1 | 11/2013 |
| WO | 2014012783 | A2 | 1/2014 |

* cited by examiner

*Primary Examiner* — Erik Kashnikow
*Assistant Examiner* — Chaim A Smith
(74) *Attorney, Agent, or Firm* — Robert E. Alderson Jr.

(57) ABSTRACT

Capsules are provided which include a cup-shaped body with a side wall having an upper edge and with a bottom wall in which a plurality of openings are defined for allowing water to enter the cup-shaped body; and a cover secured to the cup-shaped body so as to close the cup-shaped body on a side opposite from the bottom wall. The cup-shaped body and the cover are configured in such a manner as to allow, in use, the infusion to exit from the capsule only at a peripheral edge of the cover.

8 Claims, 6 Drawing Sheets

CAPSULES FOR INFUSION PRODUCTS

CROSS-REFERENCE TO RELATED APPLICATIONS

This application is a National Phase Application of PCT International Application No. PCT/IB2015/052908, International Filing Date, Apr. 21, 2015 claiming priority to Italian Patent Application No. TO2014A000338, filed Apr. 22, 2014, each of which is hereby incorporated by reference in its entirety.

FIELD OF THE INVENTION

The present invention relates in general to capsules for infusion products, such as coffee, intended for use in beverage extracting machines, as described and claimed herein.

BACKGROUND OF THE INVENTION

A capsule of the type identified above is known, for example, from WO2010/137955.

The invention is described below with specific reference to its application to a coffee capsule, but it is to be considered as generally applicable to a capsule for any other infusion product.

A coffee capsule typically comprises a cup-shaped body, in particular a body of frustoconical shape, which contains the coffee, and a cover which closes the cup-shaped body. The cup-shaped body is typically made of plastic material. The cover, which is a separate component from the cup-shaped body, is typically also made of plastic material or of an aluminium foil.

In order to produce the coffee/water infusion, the capsule is inserted into a percolation chamber of the coffee machine, where a certain quantity of hot water is injected under pressure into the cup-shaped body of the capsule through a plurality of holes provided in the bottom of the cup-shaped body, so as to mix with the coffee inside the cup-shaped body. The beverage produced by the infusion then exits from the cup-shaped body through a plurality of openings made in the cover of the capsule.

In some known solutions, the beverage exits from the cup-shaped body of the capsule through openings in the cover of the capsule which are produced by the interaction between the cover and a plurality of protruding elements which project inwards from a bottom wall of the percolation chamber of the machine. As a result of the pressure increase inside the cup-shaped body due to the introduction of the pressurized hot water, the cover, which is made for example of an aluminium foil, deforms until it comes into contact with the protruding elements of the percolation chamber. The contact between the protruding elements and the cover causes the cover to be cut in several points thereof. The infusion exits from the capsule through the passages created by these cuts and is conveyed to a final container, such as a coffee cup.

Moreover, as is known, measures are increasingly commonly adopted in coffee machines to facilitate the formation of a "cream", which is particularly appreciated by coffee consumers. The coffee cream is produced by promoting the formation of an intimate emulsion of air within the coffee infusion leaving the capsule. In order to obtain an acceptable coffee cream it is necessary to prevent air from remaining trapped in bubbles, as this would simply lead to the formation of a coffee froth, which is not at all appreciated by the average consumer.

Special devices, known as "emulsifying devices", have been devised for fitting to coffee machines in order to promote the formation of the coffee cream. However, the use of emulsifying devices in coffee machines disrupts the overall design of the machines, leading to considerable increases in the manufacturing cost of the machines, as well as to lower reliability of the beverage preparing and delivering process.

There is therefore a particularly strongly felt need to cause formation of the coffee cream by means of the particular shaping of the capsule, rather than by means of an emulsifying device fitted to the machine.

SUMMARY OF THE INVENTION

This and other objects are fully achieved according to the present invention by means of capsules having the characteristics described and claimed herein.

This and other objects are fully achieved according to the present invention by means of a capsule having the characteristics specified in the attached independent claim 1.

Advantageous embodiments of the invention are the subject-matter of the dependent claims.

Briefly, the invention is based on the idea of providing a capsule in which the cup-shaped body and the cover are configured in such a manner as to allow, in use, exit of the infusion from the capsule only at a peripheral edge of the cover. The exit of the infusion from the capsule may take place either through a single passage extending along the whole peripheral edge of the cover, or through a plurality of passages, separate from each other, provided along the peripheral edge of the cover. Because of the peripheral friction to which the infusion is subject as it exits from the capsule through the peripheral passage(s) between the cup-shaped body and the cover, the desired coffee cream is obtained without the need to fit an appropriate emulsifying device to the machine.

Preferably, the single peripheral passage, or each peripheral passage where a plurality of peripheral passages separate from each other are provided for, is closed by a respective membrane formed by the cover, said membrane being adapted to deform so as to allow the infusion to flow out of the capsule when the pressure exerted by the infusion inside the capsule exceeds a given threshold. Accordingly, the exit of the infusion from the capsule takes place only when said pressure threshold is exceeded, whereas the infusion is retained inside the capsule until said pressure threshold is reached, enabling a full-bodied coffee to be obtained.

Preferably, the cover is releasably coupled to the cup-shaped body, thereby making the capsule recyclable, since the content of the capsule can be easily separated from the (plastic) material of the capsule itself.

Embodiments of the present invention will now be described purely by way of non-limiting examples with reference to the attached drawings.

DETAILED DESCRIPTION

Figure 2:
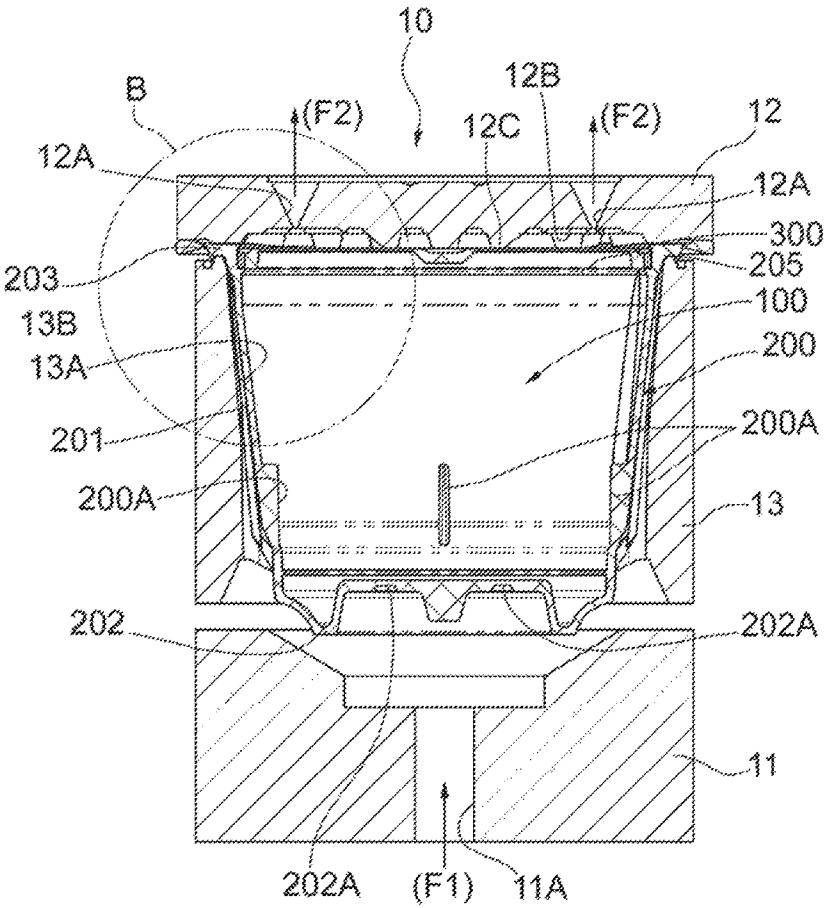
FIG. 2 is a cross-sectional view, taken along section line II-II, of the portion of percolation head of FIG. 1 and of the capsule inserted therein.
Figure 1:
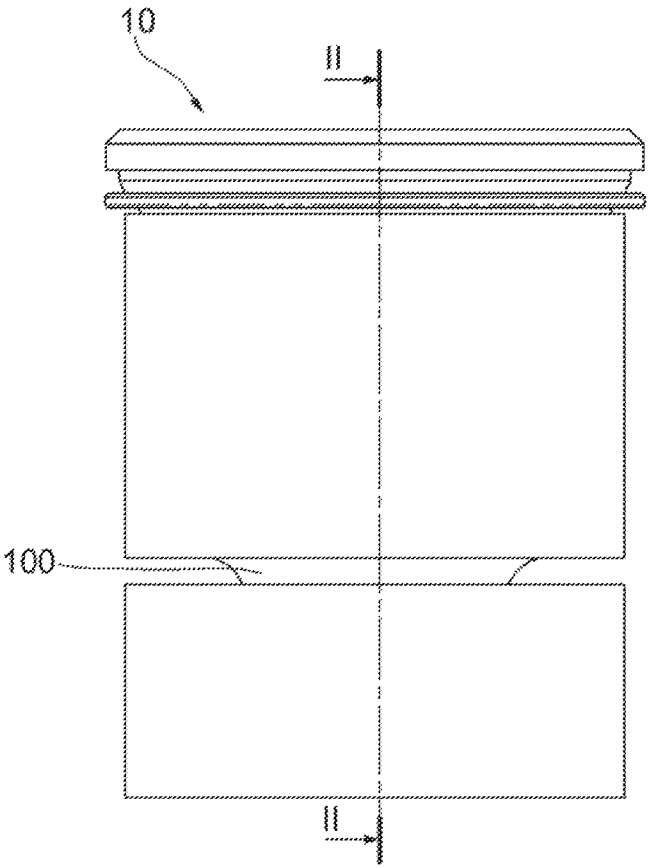
FIG. 1 shows a front view of a portion of the percolation head of a coffee machine with a coffee capsule according to the present invention inserted therein, the coffee capsule being only partially visible.

With reference first to FIGS. 1 and 2, a percolation head (only a portion of which is shown in FIGS. 1 and 2) of a conventional coffee machine is indicated 10, while a coffee capsule 100 according to the present invention, inserted into the percolation head 10, is indicated 100. FIGS. 1 and 2 show the percolation head 10 and the capsule 100 rotated through 180° relative to the actual orientation they normally have in coffee machines.

The percolation head 10 comprises a first plate 11 from which pressurized hot water enters through an inlet channel 11A, as indicated by arrow F1, a second plate 12 having a plurality of outlet openings 12A through which the water and coffee infusion exits, as indicated by arrow F2, and a percolation chamber 13 which is interposed between the two plates 11 and 12 and has a cavity 13A for receiving the capsule 100. A plurality of protruding elements 12C are provided, in per-se-known manner, on the inner face 12B of the second plate 12.

With reference to FIGS. 2 to 9, the capsule 100 comprises a cup-shaped body 200 and a cover 300 which closes the cup-shaped body 200 on the top side. As shown in FIG. 2, in use, the outer surface of the cover 300 of the capsule 100 bears against the protruding elements 12C of the second plate 12 of the percolation head 10.

The cup-shaped body 200 comprises a side wall 201 and a bottom wall 202 which closes the side wall 201 on the bottom side. Preferably, the cup-shaped body 200 has a generally frustoconical shape.

The side wall 201 ends at its top in an upper edge 203, which in plan view has the shape of a circular ring. Advantageously, but not necessarily, the side wall 201 has a plurality of slots 200A (FIGS. 2 and 7) which, in per-se-known manner, improve the formation of the infusion inside the cup-shaped body 200.

The bottom wall 202 will not be described in detail here, since its configuration has no relevance for the purposes of the invention. It will be sufficient to point out that the bottom wall 202 has a plurality of openings 202A through which the pressurized hot water flows into the cup-shaped body 200 of the capsule to form the desired infusion.

Figure 4:
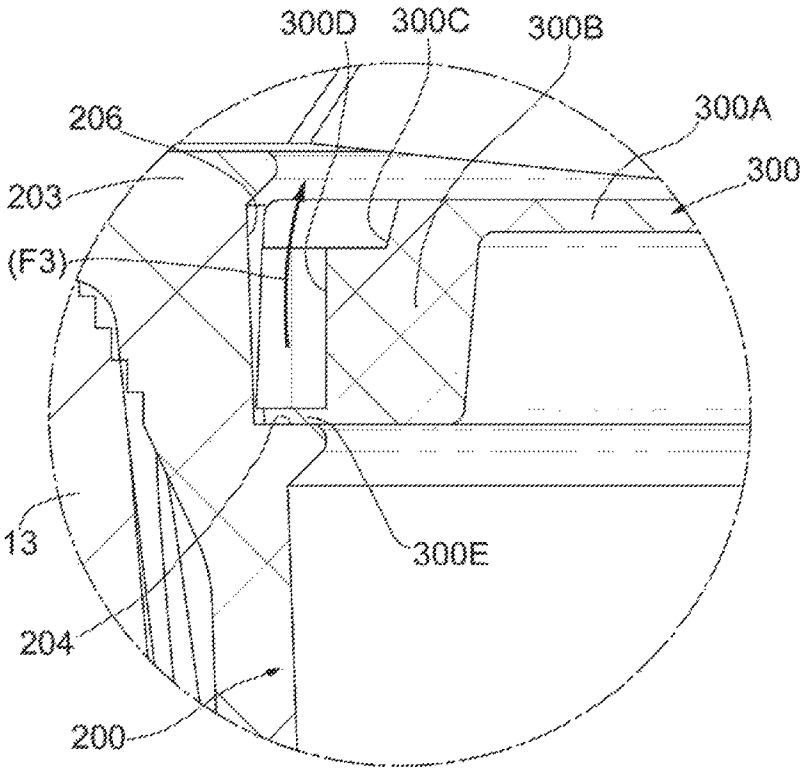
FIG. 4 shows, on an enlarged scale, the detail B1 of FIG. 3.
Figure 3:
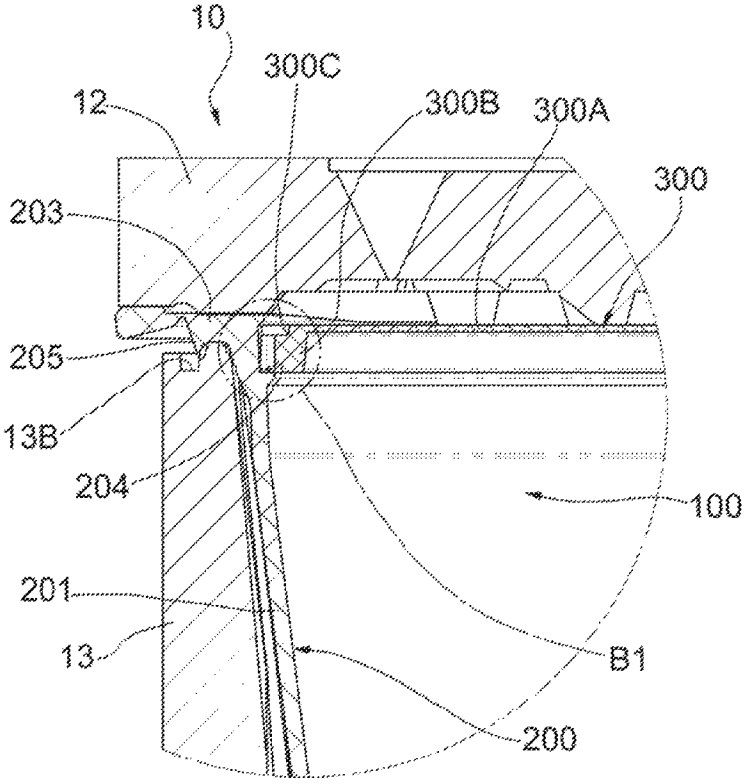
FIG. 3 shows, on an enlarged scale, the detail B of FIG. 2.
Figure 6:
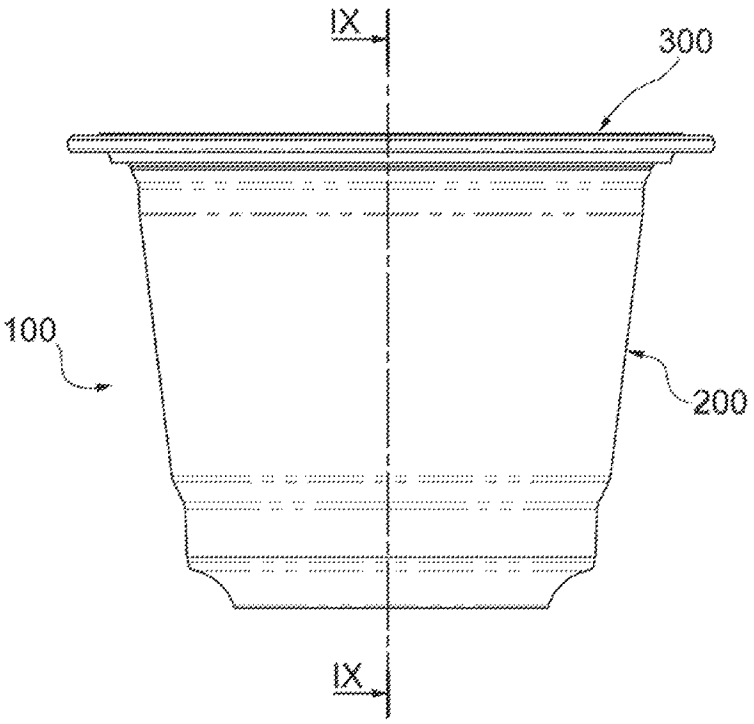
FIG. 6 shows a front view of the capsule of FIG. 5.
Figure 5:
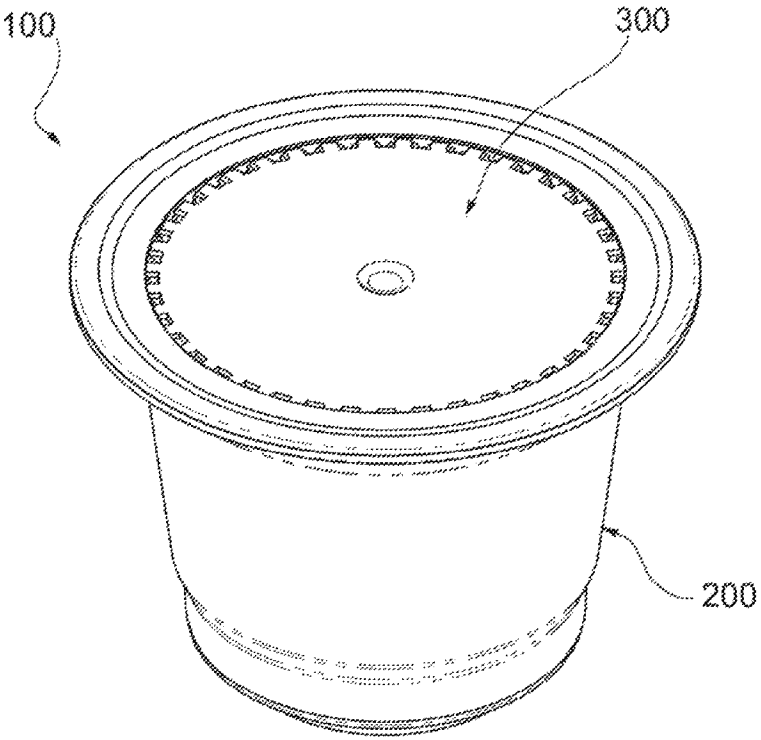
FIG. 5 is a perspective view of a coffee capsule according to a first embodiment of the present invention.
Figure 8:
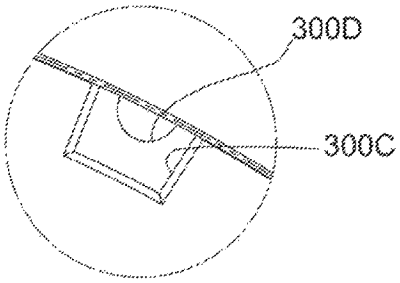
FIG. 8 shows, on an enlarged scale, the detail D of FIG. 5.
Figure 9:
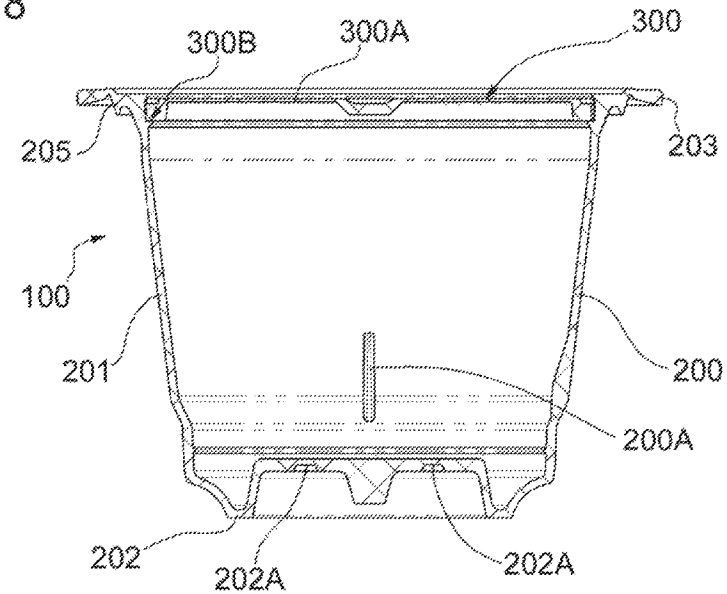
FIG. 9 is a cross-sectional view, taken along section line IX-IX, of the capsule of FIG. 6.
Figure 7:
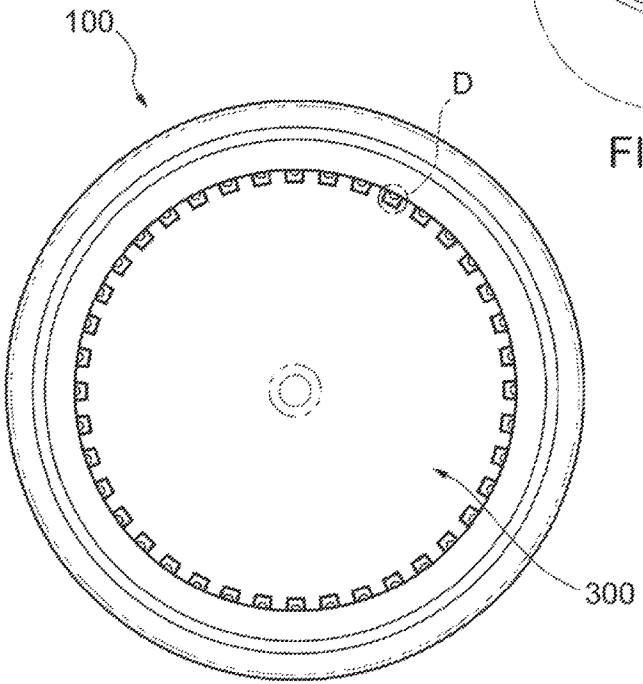
FIG. 7 shows a top view of the capsule of FIG. 5.

As shown in greater detail in FIGS. 3 and 4, a shoulder 204, which also has the shape of a circular ring in plan view, and on which the cover 300 bears in use, is provided at the upper edge 203 of the cup-shaped body 200. Preferably, the capsule 100 is configured in such a manner that the upper surface of the cover 300 never exceeds the height of the upper edge 203 of the cup-shaped body 200, that is to say, in such a manner that the cover 300 is entirely contained inside the cup-shaped body 200.

A catch 205, which projects downwards along the whole circumference of the edge 203 and which, in use, engages in a corresponding annular groove 13B formed on the top face of the percolation chamber 13, is provided at the upper edge 203 of the cup-shaped body 200. In use, once the catch 205 is engaged in the groove 13B, the second plate 12 is closed towards to the first plate 11 so as to clamp the edge 203 on to the top face of the percolation chamber 13.

The cover 300 comprises a middle portion 300A in the form of a solid circle and a peripheral edge 300B which surrounds the middle portion 300A. Preferably, the peripheral edge 300B has a greater thickness than the middle portion 300A and projects towards the inside of the cup-shaped body 200. The cover 300 is secured to the cup-shaped body 200 by fitting into an annular seat 206 provided in the upper edge 203, said annular seat being closed at its bottom end by the shoulder 204.

The peripheral edge 300B of the cover 300 is shaped substantially in the form of a circular ring. Preferably, a plurality of peripheral recesses 300C (shown in detail in FIG. 8) are provided in the peripheral edge 300B, more precisely on the side of the peripheral edge facing outwardly of the capsule. Each peripheral recess 300C is associated to a corresponding peripheral cut-out 300D (FIGS. 4 and 8) which has, for example, a cross-section of substantially semi-circular shape, and which extends through most of the thickness of the peripheral edge 300B. Each pair formed by a peripheral recess 300C and by the associated peripheral cut-out 300D defines a peripheral passage closed at its bottom by a respective membrane 300E (FIG. 4) which is formed by the peripheral edge 300B and bears on the shoulder 204 of the cup-shaped body 200.

The operation of the capsule 100 will now be described.

The pressurized hot water fed into the percolation chamber 13 through the inlet channel 11A of the first plate 11 of the percolation head 10 flows into the cup-shaped body 200 of the capsule 100, through the openings 202A provided in the bottom wall 202 of the capsule.

The pressure of the infusion inside the cup-shaped body 200 causes deformation of the middle portion 300A (thin portion) of the cover 300, but this portion remains intact and therefore prevents the infusion from leaving the capsule.

When the pressure of the infusion inside the cup-shaped body 200 exceeds a given threshold, the membranes 300E formed by the peripheral edge 300B of the cover 300 deform too, and therefore allow, also by virtue of the clearance between the cover 300 and the upper edge 203 of the cup-shaped body 200, the infusion to flow out of the cup-shaped body 200 through the passages formed by the peripheral cut-outs 300D and by the peripheral recesses 300C, as indicated by arrow F3 in FIG. 4.

The flow of the infusion through the gaps created between the shoulder 204 and the membranes 300E as a result of the deformation of the latter gives rise to a degree of friction on the infusion and therefore a degree of emulsification of the air in the infusion, this emulsification being then completed by the impact of the infusion against the protruding elements 12C formed by the second plate 12 of the percolation head 10.

A person skilled in the art will be capable, by suitably selecting the thicknesses of the middle portion 300A and/or of the peripheral edge 300B of the cover 300, as well as the number and/or the thickness of the membranes 300E, of optimizing the overall process of emulsification of the air in the infusion and therefore of obtaining the desired amount of coffee cream.

As will be evident in the light of the above description, a first advantage of the coffee capsule of the present invention is that it makes it possible to obtain a coffee which at the same time is full-bodied, owing to the first infusion step in which the infusion is retained inside the capsule, and has a high cream content, because of the peripheral friction to which the infusion is subject when it flows out of the capsule through the passages created between the cup-shaped body and the cover as a result of the deformation of the membranes, without the need to fit an appropriate emulsifying device to the machine, thereby enabling the capsule to be used on machines which are simpler and consequently more reliable.

A further advantage of the present invention is that the capsule is recyclable, since the cover is releasable from the cup-shaped body and therefore the content of the capsule is easily separable from the (plastic) material of the capsule.

Naturally, principles of the invention remaining unchanged, embodiments and constructional details may be greatly modified with respect to those described purely by way of non-limiting examples, without thereby departing from the scope of protection as claimed herein.

In particular, it should be noted that the use of a plurality of pairs of peripheral recesses and cut-outs, each forming a respective peripheral passage closed at its bottom by a respective membrane, is one of the possible ways of enabling the infusion to exit from the capsule solely at the peripheral edge of the cover.

Figure 10:
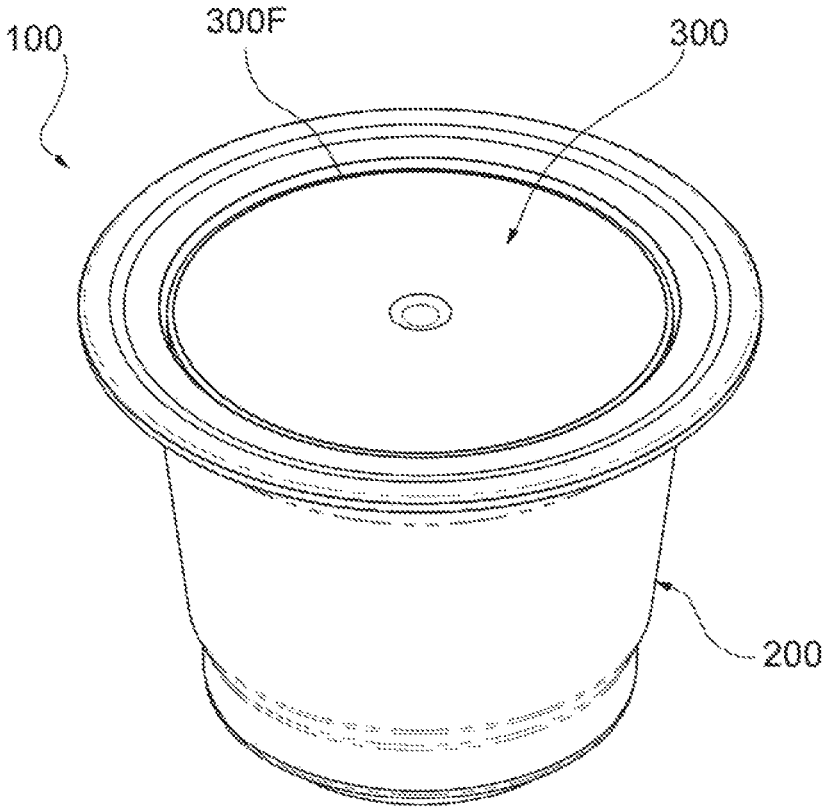
FIG. 10 is a perspective view of a coffee capsule according to another embodiment of the present invention.
Figure 12:
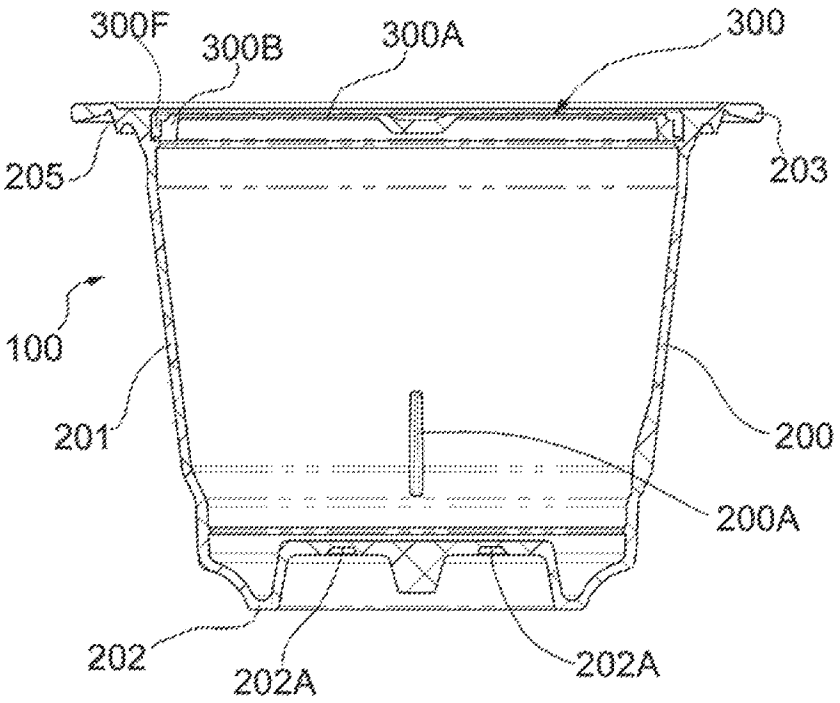
FIG. 12 is a cross-sectional view of the capsule of FIG. 10.
Figure 11:
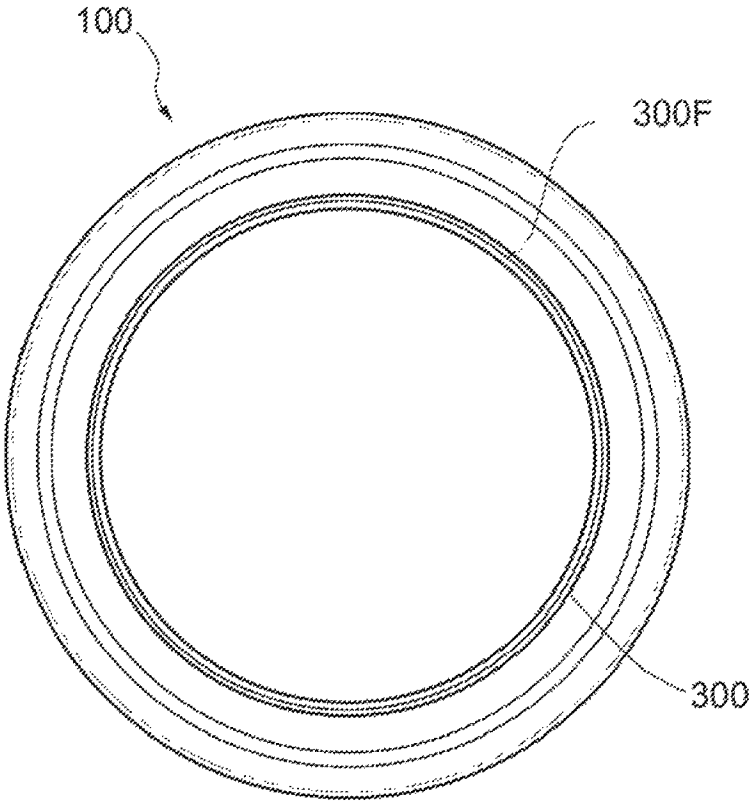
FIG. 11 shows a top view of the capsule of FIG. 10.

For example, as shown in the embodiment of FIGS. 10 to 12, where parts and elements identical or correpsonding to those of the capsule of FIGS. 5 to 9 are indicated with the same reference numerals, in place of a plurality of peripheral passages separate from each other, a single peripheral passage (indicated at 300F) can be provided between the upper edge 203 of the cup-shaped body 200 and the cover 300, this single passage 300F being produced by appropriate shaping of the cover 300 and of the upper edge 203 of the cup-shaped body 200 in the area where these components of the capsule are coupled with each other. In this case, the cover 300 will preferably form a single peripheral membrane adapted to normally close the peripheral passage 300F between the cup-shaped body 200 and the cover 300, but to deform in case of an increase in the pressure of the infusion inside the capsule above a given threshold so as to allow the infusion to flow out of the capsule.

The invention claimed is:

1. A capsule for infusion products comprising:

a cup-shaped body with a side wall having an upper edge and with a bottom wall in which a plurality of openings are defined for allowing water to enter the cup-shaped body; and a cover secured to the cup-shaped body so as to close the cup-shaped body on a side opposite from the bottom wall;

wherein the cover comprises a main circular portion without holes therein and a peripheral edge which extends adjacent and around said main circular portion and has a greater thickness than said main circular portion;

wherein the peripheral edge of the cover is fitted into an annular seat provided in said upper edge and has a plurality of peripheral recesses forming with said upper edge a corresponding plurality of peripheral passages separate from each other allowing, in use, an infusion to exit from the capsule.

2. The capsule of claim 1, wherein each peripheral passage is closed by a respective deformable membrane formed by the cover, said deformable membrane being adapted to deform so as to allow the infusion to flow out of the capsule when the pressure exerted by the infusion inside the capsule exceeds a given threshold.

3. The capsule of claim 2, wherein each one of said deformable membranes rests on a peripheral shoulder which closes the bottom of the annular seat.

4. The capsule of claim 1, wherein the cover is entirely contained inside the cup-shaped body, without protruding beyond said upper edge.

5. A capsule for infusion products comprising:

a cup-shaped body with a side wall having an upper edge and with a bottom wall in which a plurality of openings are defined for allowing water to enter the cup-shaped body; and a cover secured to the cup-shaped body so as to close the cup-shaped body on a side opposite from the bottom wall;

wherein the cover comprises a main circular portion without holes therein and a peripheral edge which extends adjacent and around said main circular portion and has a greater thickness than said main circular portion;

wherein the peripheral edge of the cover is fitted into an annular seat provided in said upper edge and forms with said upper edge a single peripheral passage extending along the entire peripheral edge of the cover and allowing, in use, an infusion to exit from the capsule.

6. The capsule of claim 5, wherein said single peripheral passage is closed by a deformable membrane formed by the cover, said deformable membrane being adapted to deform so as to allow the infusion to flow out of the capsule when the pressure exerted by the infusion inside the capsule exceeds a given threshold.

7. The capsule of claim 6, wherein said deformable membrane rests on a peripheral shoulder which closes the bottom of the annular seat.

8. The capsule of claim 5, wherein the cover is entirely contained inside the cup-shaped body, without protruding beyond said upper edge.

* * * * *